US006679589B2

(12) United States Patent
Takahagi et al.

(10) Patent No.: US 6,679,589 B2
(45) Date of Patent: Jan. 20, 2004

(54) INK JET PRINT HEAD AND METHOD OF PRODUCTION THEREOF

(75) Inventors: Hiroshi Takahagi, Hitachinaka (JP); Nobuhiro Noto, Hitachinaka (JP); Yutaka Shoji, Hitachinaka (JP); Yoshitaka Akiyama, Hitachinaka (JP); Kenji Yamada, Hitachinaka (JP); Kenichi Kugai, Hitachinaka (JP)

(73) Assignee: Hitachi Printing Solutions, Ltd., Kanagawa-ken (JP)

( * ) Notice: Subject to any disclaimer, the term of this patent is extended or adjusted under 35 U.S.C. 154(b) by 0 days.

(21) Appl. No.: 10/158,457

(22) Filed: May 31, 2002

(65) Prior Publication Data

US 2002/0180844 A1 Dec. 5, 2002

(30) Foreign Application Priority Data

Jun. 1, 2001 (JP) ..... P2001-167100

(51) Int. Cl.[7] ..... B41J 2/045
(52) U.S. Cl. ..... 347/70
(58) Field of Search ..... 347/54, 68–72; 29/25.35, 890.1; 310/324, 328

(56) References Cited

U.S. PATENT DOCUMENTS 5,446,485 A * 8/1995 Usui et al. ..... 347/72
6,530,652 B1 * 3/2003 Kim et al. ..... 347/70

FOREIGN PATENT DOCUMENTS

JP 403184411 A * 8/1991 ..... 333/187

* cited by examiner

*Primary Examiner*—Stephen D. Meier
*Assistant Examiner*—An H. Do
(74) *Attorney, Agent, or Firm*—Whitham, Curtis & Christofferson, P.C.

(57) ABSTRACT

An ink jet print head includes pressure chambers, a diaphragm forming a side of the pressure chambers, stacked piezoelectric elements, a piezoelectric element fixing plate, and a housing. The stacked piezoelectric elements are attached to the diaphragm in a one-to-one correspondence with pressure chambers. The piezoelectric element fixing plate is fixedly attached to and supports the stacked piezoelectric elements. The housing includes a common ink channel portion that supplies ink to the pressure chambers. The piezoelectric element fixing plate and the stacked piezoelectric elements are disposed at least partially in the space defined by the diaphragm and internal side walls of the ink channel portion with a gap existing between the piezoelectric element fixing plate and the internal side walls.

8 Claims, 12 Drawing Sheets

INK JET PRINT HEAD AND METHOD OF PRODUCTION THEREOF

BACKGROUND OF THE INVENTION

1. Field of the Invention

The present invention relates to an ink jet print head for use in an office or industrial environment, and also to a method of producing the ink jet print head.

2. Description of the Related Art

FIG. 1 is a cross-sectional view showing an example of a conventional ink jet print head. The ink jet print head includes an orifice plate 302 formed with a nozzle 301, a chamber plate 304 formed with a pressure chamber 303, a restrictor plate 306 formed with a restrictor 305, a diaphragm/filter plate 309 formed with a diaphragm 307 and a filter 308, a housing 311 formed with a common ink channel 310, a piezoelectric element 312, and a piezoelectric element fixing plate 313 for fixing the piezoelectric element 312 in place. The piezoelectric element 312 is made up of a number of plate-shaped piezoelectric material pieces and a number of electrodes alternately stacked one on the other. For the sake of brevity, the piezoelectric element will be hereinafter referred to simply as "piezoelectric element".

The housing 311 includes edges X1 and Y1 for setting the position of the piezoelectric element fixing plate 313 in the X and Y directions, respectively. The piezoelectric element fixing plate 313 is abutted against and fixed to the edges X1 and Y1 by adhesive (not shown). The adhesive must be applied according to the machining precision of the positioning edges X1, Y1 and must be applied thinly.

However, in order to reduce variation in ink ejection, the diaphragm 307 and the piezoelectric element 312 need to be attached to each other with great positional accuracy. This requires that the housing 311 and the piezoelectric element fixing plate 312 be machined with extreme precision. For example, the distance from the positioning edge Y2 of the piezoelectric element fixing plate 313 to where the piezoelectric element 312 is adhered to the diaphragm 307 must be extremely precise so the positioning edges X1, Y1 must be machined in the housing 311 with extremely high precision. Also, the corners between various surfaces must be extremely close to perfect right angles. If not, the surface X1 adhered to the piezoelectric element fixing plate 313 will lean toward or away from the diaphragm 307, so that the surface of the piezoelectric element 312 that is adhered to the diaphragm 307 will also slant with regard to the diaphragm 307. Full and uniform contact between the adhered surfaces of the piezoelectric element 312 and the diaphragm 307 cannot be achieved.

If the adhesive layer is too thin or non-uniform, then the piezoelectric element fixing plate 313 cannot be adhered in accordance with the reference edges X1, Y1. As a result, the adhering surfaces of the diaphragm 307 and the piezoelectric element 312 will not contact each other uniformly, resulting in the diaphragm 307 and the piezoelectric element 312 being adhered to each other at a slant.

When the housing 311 and the piezoelectric element fixing plate 313 are made from different materials having different thermal expansion coefficients, then the ink jet head can suffer from warping if the piezoelectric element fixing plate 313 is fixed to the housing 311 by adhesive, for example. The warping can result in variations in ink ejection properties, especially at the end nozzles.

For these reasons, in order to reduce variation in ink ejection, the precision of all components and the thickness of the adhesive must be managed carefully. Components such as the housing 311 and the piezoelectric element fixing plate 313 must be made with high machining precision and so are expensive. As a result, the ink jet head is expensive to make.

SUMMARY OF THE INVENTION

In view of the foregoing, it is an object of the present invention to overcome the above-described problems and to provide an inexpensive ink jet print head with less positional shift between the piezoelectric elements and the diaphragm and reduced variation in ink ejection properties, and a method of manufacturing the ink jet print head.

In order to achieve the above-described objectives, an ink jet print head according to the present invention includes a pressure chamber portion with pressure chambers, an orifice plate, a restrictor plate, a diaphragm forming a side of the pressure chambers, stacked piezoelectric elements, a piezoelectric element fixing plate, and a housing. The orifice plate is formed with orifices in a one-to-one correspondence with the pressure chambers. Each orifice brings a corresponding pressure chamber into fluid communication with atmosphere. The restrictor plate is formed with ink channels in fluid communication with the pressure chambers. The stacked piezoelectric elements are attached to the diaphragm in a one-to-one correspondence with the pressure chambers. Each stacked piezoelectric element generates, through the diaphragm, a pressure fluctuation in a corresponding pressure chamber when applied with an electric signal. The piezoelectric element fixing plate is fixedly attached to and supports the stacked piezoelectric elements.

The housing includes a common ink channel portion and internal side walls. The common ink channel portion is formed with a common ink channel in fluid communication with the channels in the restrictor plate. The internal side walls adjoin the diaphragm at one side to define a space that is open at an end opposite from the diaphragm. The piezoelectric element fixing plate and the stacked piezoelectric elements are disposed at least partially in the space with a gap existing between the piezoelectric element fixing plate and the internal side walls that define the space.

According to a method of the present invention for producing an ink jet print head, first a piezoelectric element set, a front end set, and a dummy restrictor plate are prepared, not necessarily in this order.

The piezoelectric element set includes a piezoelectric element fixing plate and stacked piezoelectric elements. The stacked piezoelectric elements are attached to the piezoelectric element fixing plate with a predetermined positioning.

The front end set includes a pressure chamber portion, an orifice plate, a restrictor plate, a diaphragm, and a housing. The pressure chamber portion has pressure chambers with positioning that corresponds to positioning of the stacked piezoelectric elements on the piezoelectric element fixing plate. The orifice plate is formed with orifices in a one-to-one correspondence with the pressure chambers. Each orifice brings a corresponding pressure chamber into fluid communication with atmosphere. The restrictor plate is formed with ink channels in fluid communication with the pressure chambers. The diaphragm forms a side of the pressure chambers. The housing includes a common ink channel, a space, and positioning holes. The common ink channel is in fluid communication with the channels in the restrictor plate. The space is defined by internal side walls that adjoin the diaphragm at one side. The space is open at an open end thereof opposite from the diaphragm. The space is large enough to insert through the open end the stacked piezoelectric elements and the piezoelectric element fixing plate until the stacked piezoelectric elements contact the diaphragm while a gap is maintained between the side walls and the piezoelectric element fixing plate. The positioning holes are disposed with a predetermined positioning.

The dummy restrictor plate includes dummy chambers and positioning holes. The dummy chambers have positioning that corresponds to positioning of the pressure chambers in the pressure chamber portion. The positioning holes have positioning that corresponds to positioning of the positioning holes of the housing.

Once the piezoelectric element set, the front end set, and the dummy restrictor plate are prepared, the positioning holes of the dummy restrictor plate are mounting on positioning pins of a positioning jig. The positioning pins of the positioning jig have a fixed positioning that corresponds to the positioning of the positioning holes of the dummy restrictor plate.

Then, the stacked piezoelectric elements of the piezoelectric element set are aligned with the dummy chambers of the dummy restrictor plate while the piezoelectric elements are observed through the dummy chambers of the dummy restrictor plate.

Then, the dummy restrictor plate is removed from the positioning jig.

Then, the front end set is mounted on the positioning jig by mounting the positioning holes of the housing on the positioning pins of the positioning jig. Adhesive is coated on one of the diaphragm of the front end set and the piezoelectric elements of the piezoelectric element set.

Then, the positioning jig is used to move the front end set toward the piezoelectric element set, while maintaining alignment between the front end set and the piezoelectric element set, until the piezoelectric element set passes into the space and the diaphragm and the stacked piezoelectric elements contact each other.

BRIEF DESCRIPTION OF THE DRAWINGS

The above and other objects, features and advantages of the invention will become more apparent from reading the following description of the embodiment and its modifications taken in connection with the accompanying drawings in which.

DETAILED DESCRIPTION OF THE EMBODIMENT

Figure 1:
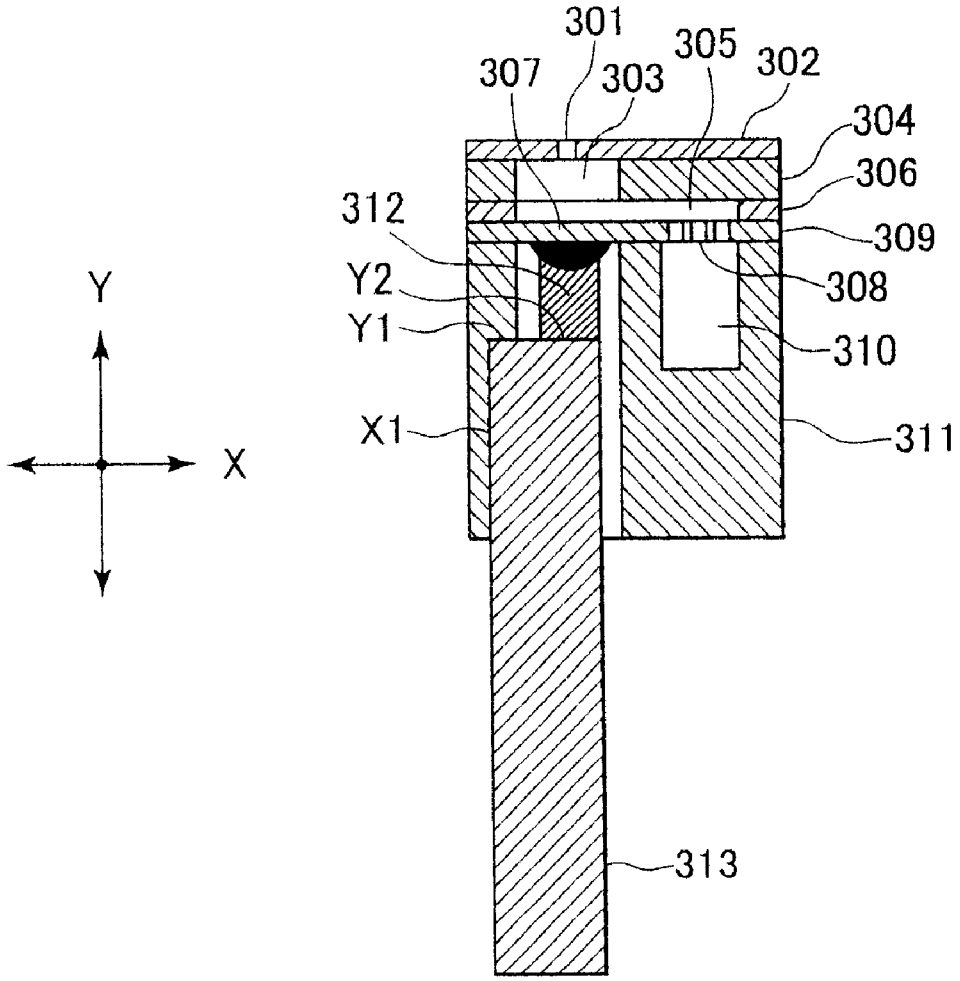
FIG.1 PRIOR ART
FIG. 1 is a cross-sectional view schematically showing a conventional ink jet print head.
Figure 3:
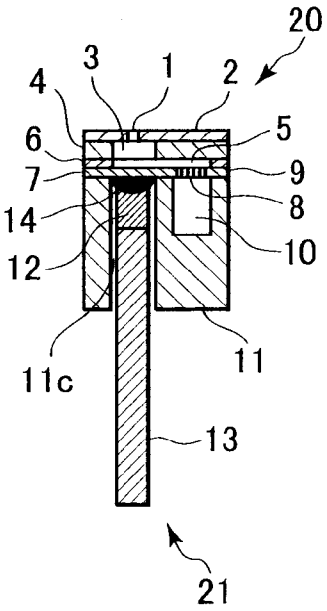
FIG. 3 is a right side cross-sectional view showing the ink jet print head of FIG. 2.
Figure 2:
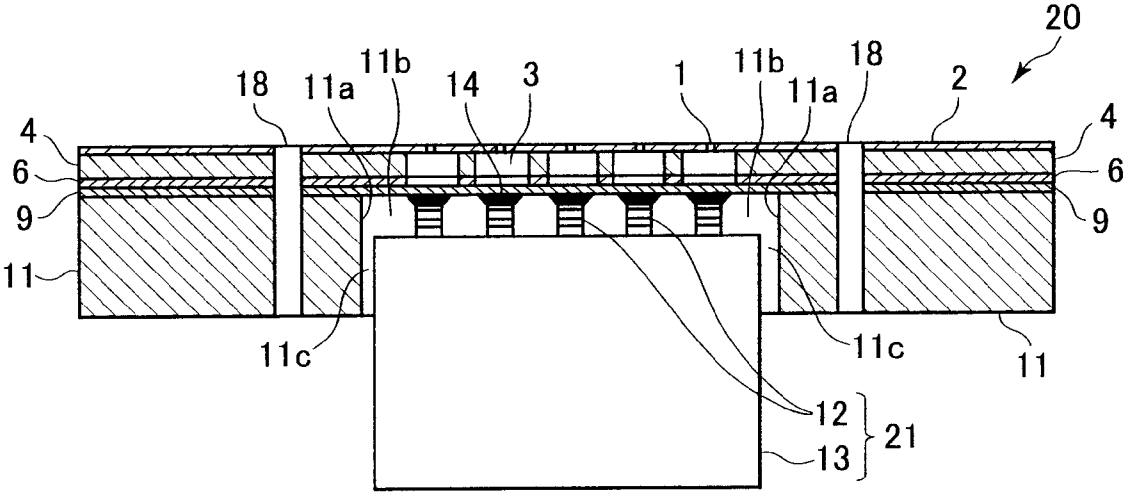
FIG. 2 is a frontal cross-sectional view showing an ink jet print head according to an embodiment of the present invention.
Figure 4:
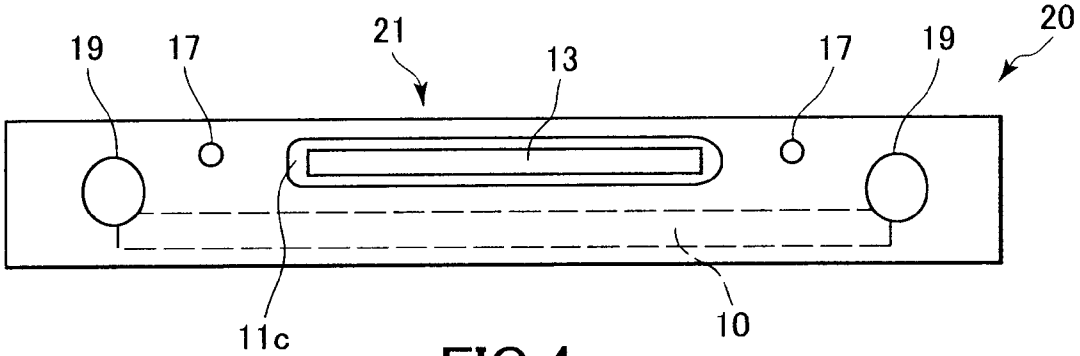
FIG. 4 is a lower view in partial cross-section showing the ink jet print head of FIG. 2.
Figure 5:
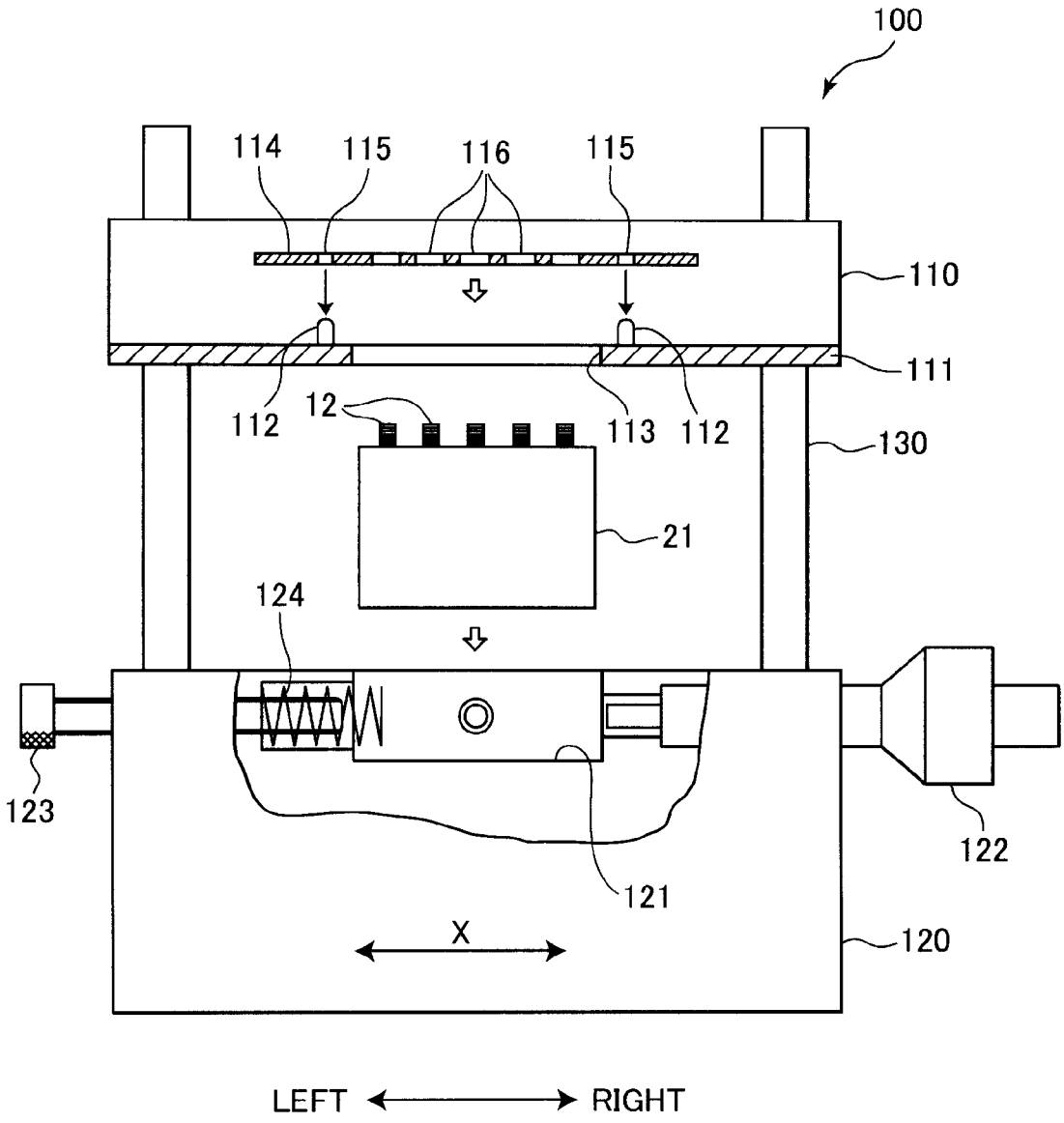
FIG. 5 is a frontal view in partial cross section showing a positioning plate and a piezoelectric element set mounted on a positioning jig.

An ink jet print head according to an embodiment of the present invention is described referring to FIGS. 2 to 4. The ink jet print head includes a front end set 20, a piezoelectric element set 21, and a cover 17. The front end set 20 includes an orifice plate 2, a chamber plate 4, a restrictor plate 6, a diaphragm plate 9, and a housing 11. The chamber plate 4 is formed with pressure chambers 3. The orifice plate 2 is formed with nozzles 1 in a one-to-one correspondence with the pressure chambers 3. Each nozzle 1 brings a corresponding pressure chamber 3 into fluid communication with atmosphere. The restrictor plate 6 is formed with restrictors 5, that serve as channels for supplying ink to the pressure chambers 3. The diaphragm plate 9 includes a diaphragm portion 7 and a filter 8. The housing 11 is formed with a common ink channel 10, internal side walls 11*a*, positioning holes 18, and ink supply ports 19. The internal side walls 11*a* adjoin the diaphragm portion 7 at one side to define a space 11*b* that is open at an end opposite from the diaphragm portion 7. The positioning holes 18 are filled with sealing or adhesive.

The piezoelectric element set 21 is disposed at least partially in the space 11*b*. A gap 11*c* exists between the piezoelectric element fixing plate 13 and the internal side walls 11*a* that define the space 11*b*, because the space 11*b* of the housing 11 is larger than the piezoelectric element 12 and the piezoelectric element fixing plate 13. The piezoelectric element set 21 includes piezoelectric elements 12 and a piezoelectric element fixing plate 13. The piezoelectric elements 12 are attached to the piezoelectric element fixing plate 13 with a predetermined positioning. The piezoelectric elements 12 are attached to the diaphragm portion 7 with adhesive 14. The piezoelectric element fixing plate 13 is fixedly attached to and supports the piezoelectric elements 12 and includes a conductor pattern (not shown). It should be noted that a conductor pattern of a flexible cable (not shown) is connected to the conductor pattern of the piezoelectric element fixing plate 13 so that signals can be applied to the piezoelectric elements 12 through the conductor pattern of the flexible cable and the conductor pattern of the piezoelectric element fixing plate 13.

Next, the method of producing the ink jet print head will be described while referring to FIGS. 5 to 12. First, the front end set 20 and the piezoelectric element set 21 are prepared. It should be noted that the nozzles 1, the pressure chambers 3, and the piezoelectric elements 12 are all provided in a mutual one-to-one correspondence. Also, a positioning plate 114 is prepared with positioning holes 115 and dummy chambers 116 with the same size and mutual positioning as the positioning holes 18 and pressure chamber 3 of the front end set 20. As will be described later, the positioning plate 114 is used to represent the front end set 20 while positioning the piezoelectric element set 21.

Figure 6:
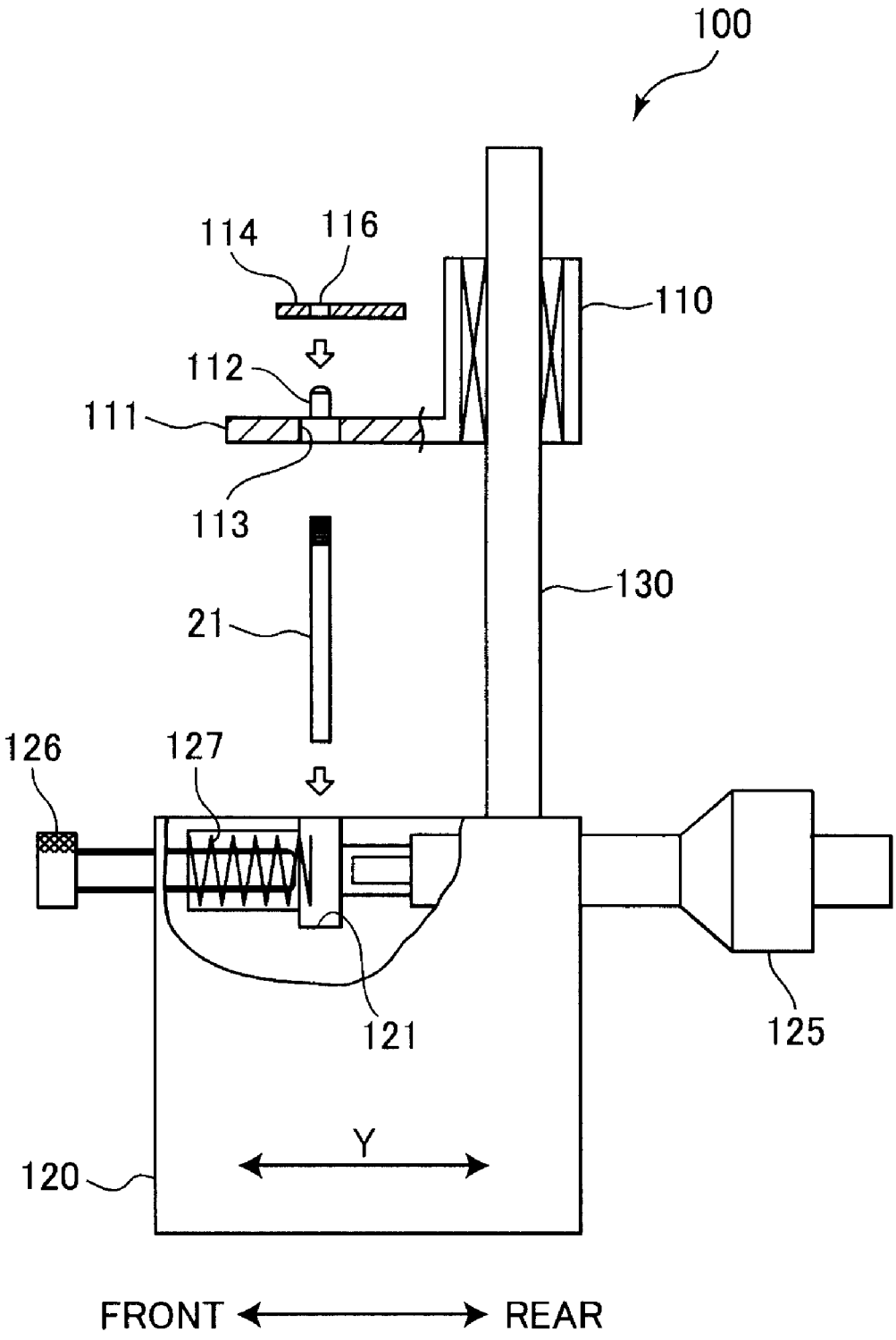
FIG. 6 is a right side view in partial cross section of the view of the FIG. 5.
Figure 7:
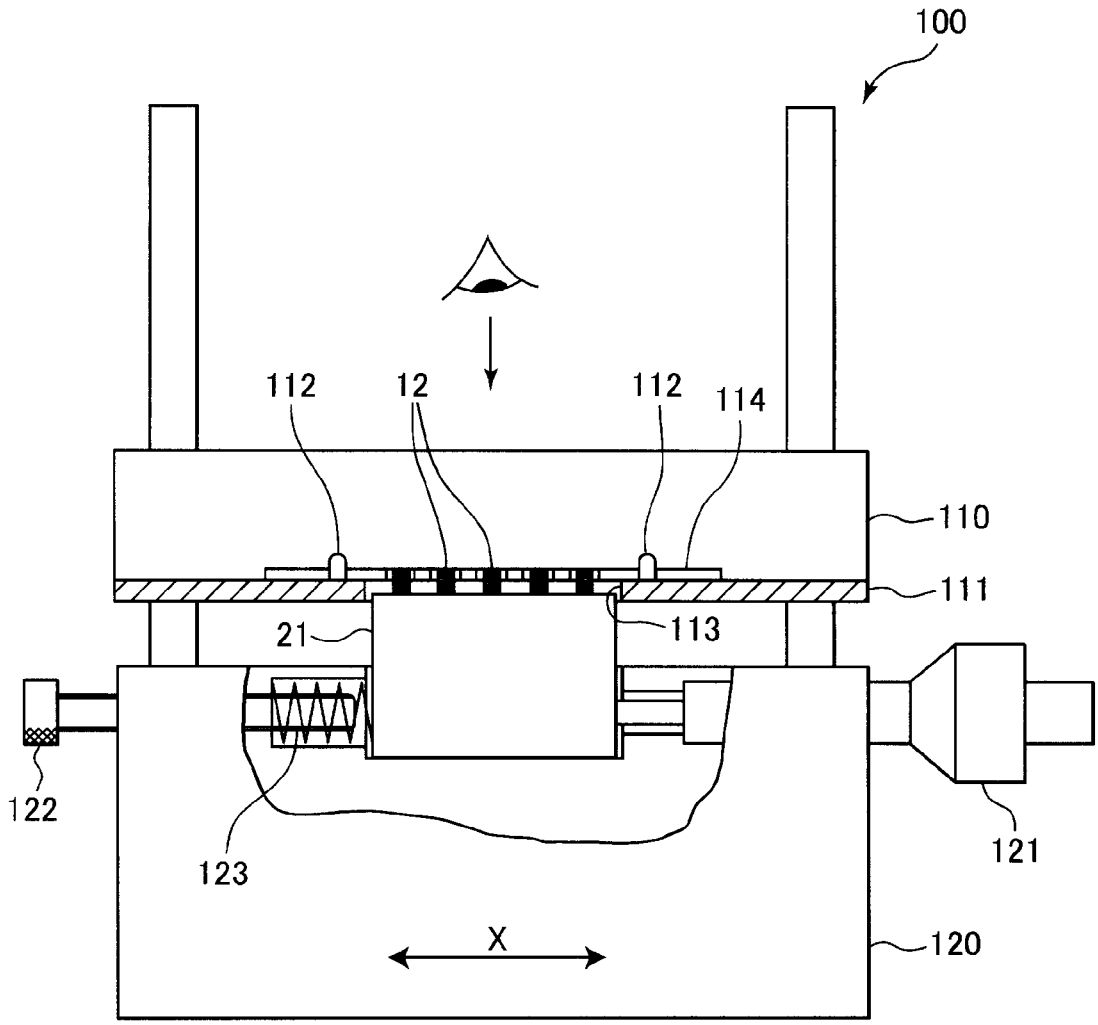
FIG. 7 is a frontal view in partial cross section showing the piezoelectric element set being positioned with respect to the positioning plate using the positioning jig.

Then, the positioning plate 114 and the piezoelectric element set 21 are mounted on a positioning jig 100. The positioning jig 100 is used for positioning and adhering the front end set 20 to the piezoelectric element set 21. As shown in FIGS. 6 and 7, the positioning jig 100 includes a front-end-set base 110, a piezoelectric element-set base 120, and a guiding jig having a linear movement guide 130. The linear movement guide 130 is fixed on the piezoelectric element-set base 120. The front-end-set base 110 is mounted on the linear movement guide 130 so as to be movable toward and away from the piezoelectric element-set base 120. The front-end-set base 110 has a substantial reclining L-shape when viewed from the side. The front-end-set base 110 includes a frontward-protruding shelf 111 formed with an opening 113 in its substantial center and with positioning pins 112 at left and right sides of the opening 113. The piezoelectric element-set base 120 includes a support surface 121, X- and Y-direction micrometer heads 122, 125, and fixing screws 123, 126. The fixing screws 123, 126 include springs 124, 127, respectively.

Figure 8:
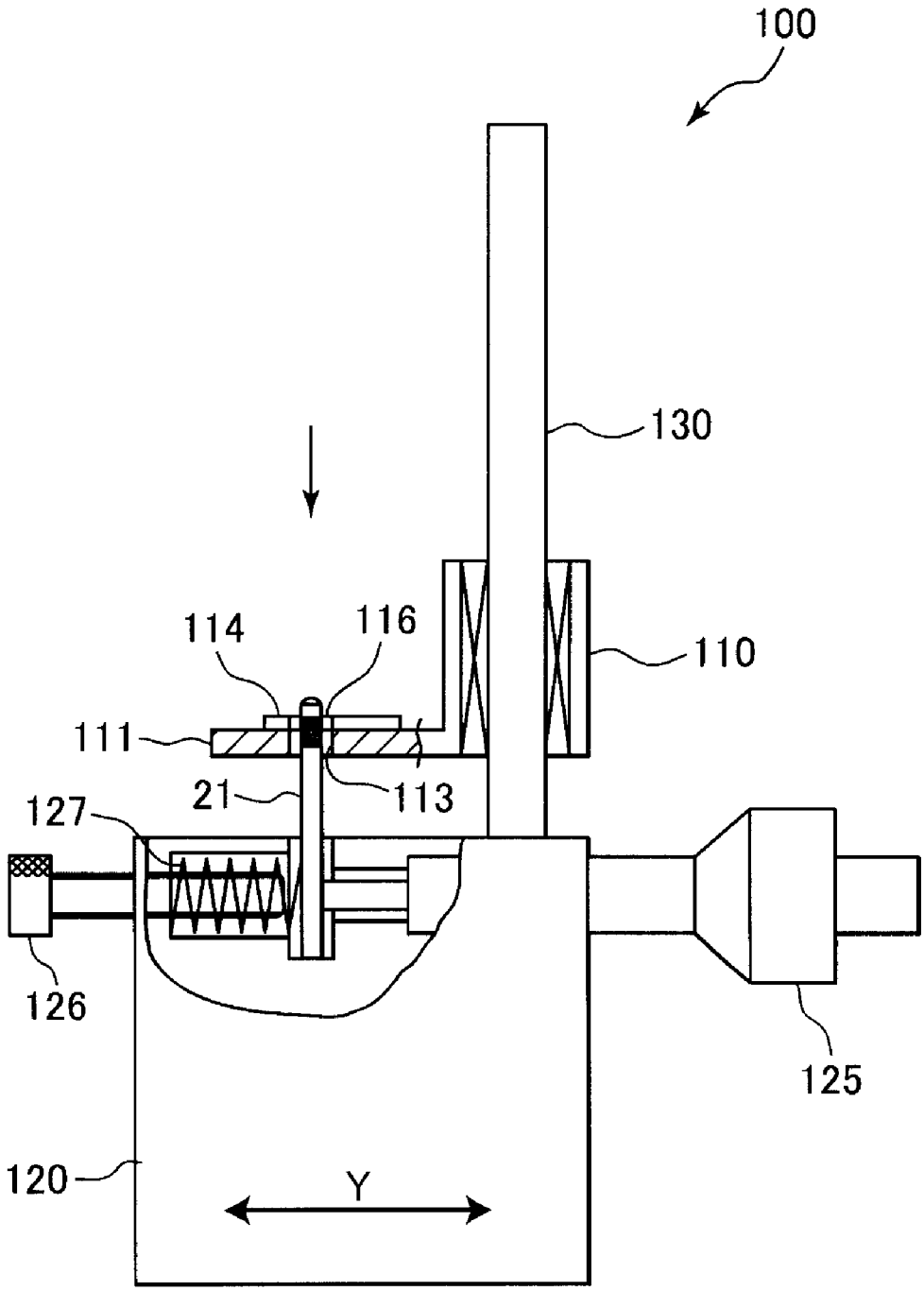
FIG. 8 is a right side view in partial cross section of the view of the FIG. 7.

The piezoelectric element set 21 is placed on the support surface 121. The positioning plate 114 is placed on the shelf 111 by fitting the positioning pins 112, 112 into the positioning holes 115, 115. Then, the front-end-set base 110 is moved following the linear movement guide 130 of the guiding jig downward toward the piezoelectric element-set base 120. While the front-end-set base 110 moves downward, the operator views the piezoelectric elements 12 from above through the dummy chambers 116 and the opening 113. Said differently, the operator views the surface of the piezoelectric elements 12 that will be adhered to the diaphragm plate 9, from the direction of the adhering surface of the diaphragm plate 9 (assuming the positioning plate 114 were replaced with the front end set 20). While observing the piezoelectric elements 12, the operator uses the X- and Y-micrometer heads 121, 125 to move the piezoelectric element set 21 by minute distances in the X and Y directions until, as shown in FIGS. 7 and 8, each piezoelectric element 12 is aligned with a corresponding dummy chamber 116. Then, the position of the piezoelectric element set 21 is fixed in place using the fixing screws 122, 126. It should be noted that two or more each of the X- and Y-direction micrometer heads can be provided to improve accuracy of positioning the piezoelectric element set 21.

Figure 10:
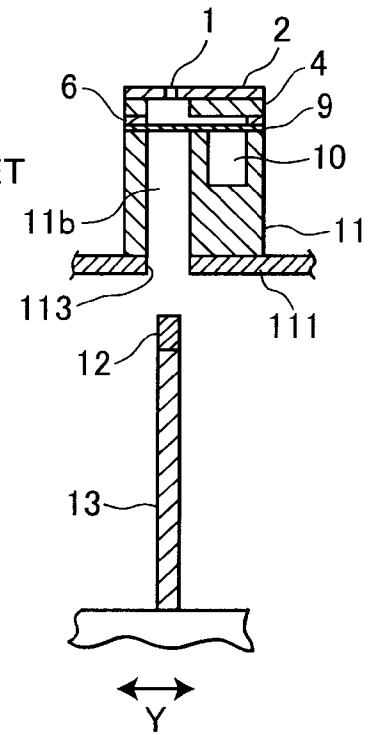
FIG. 10 is a right side view in partial cross section of the view of the FIG. 9.
Figure 9:
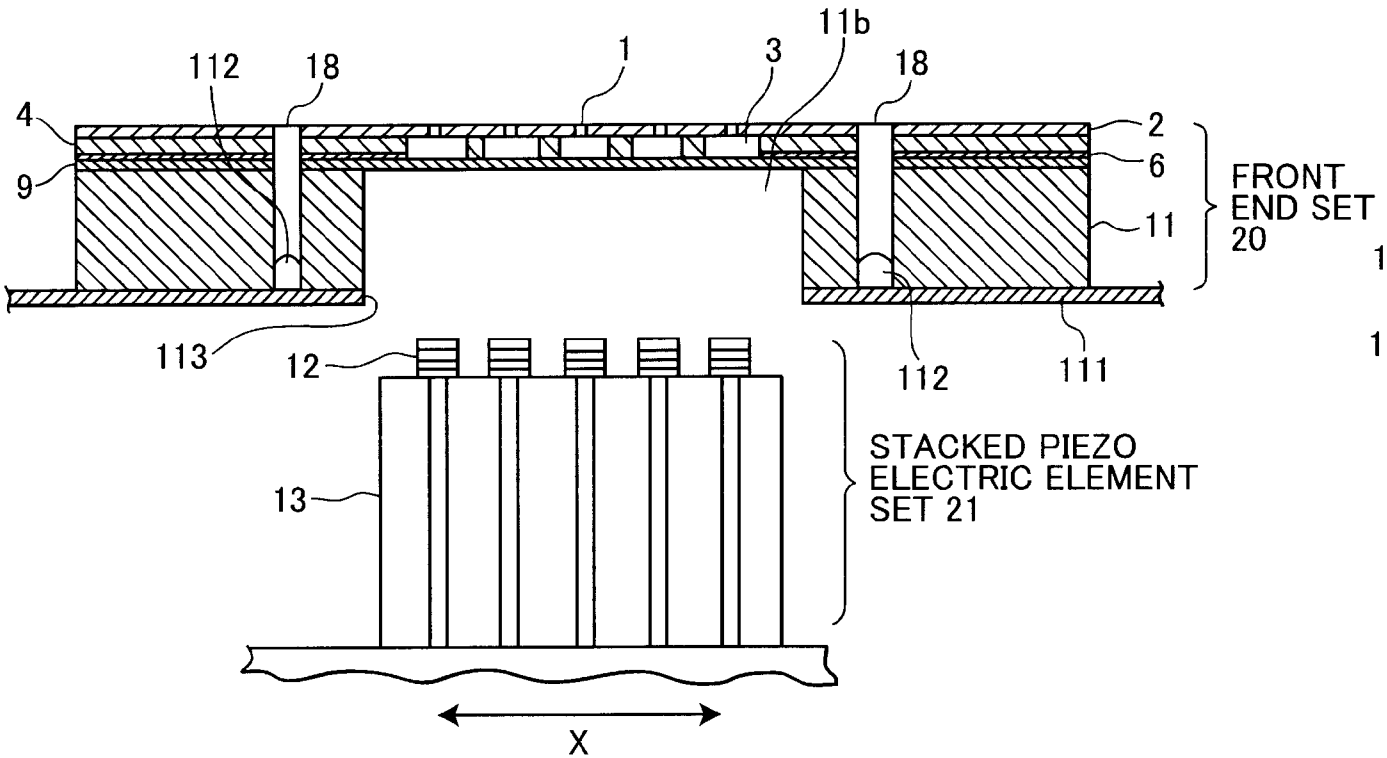
FIG. 9 is a frontal view in partial cross section showing a front end set mounted on the positioning jig in place of the positioning plate.

Then, the front-end-set base 110 is raised upward and the positioning plate 114 is removed from the shelf 111. Next, as shown in FIGS. 9 and 10, the front end set 20 is placed on the shelf 111 by fitting the positioning pins 112, 112 into the positioning holes 18, 18. Adhesive 14, while still uncured, is coated on either the diaphragm portion 7 or the piezoelectric elements 12.

Figure 11:
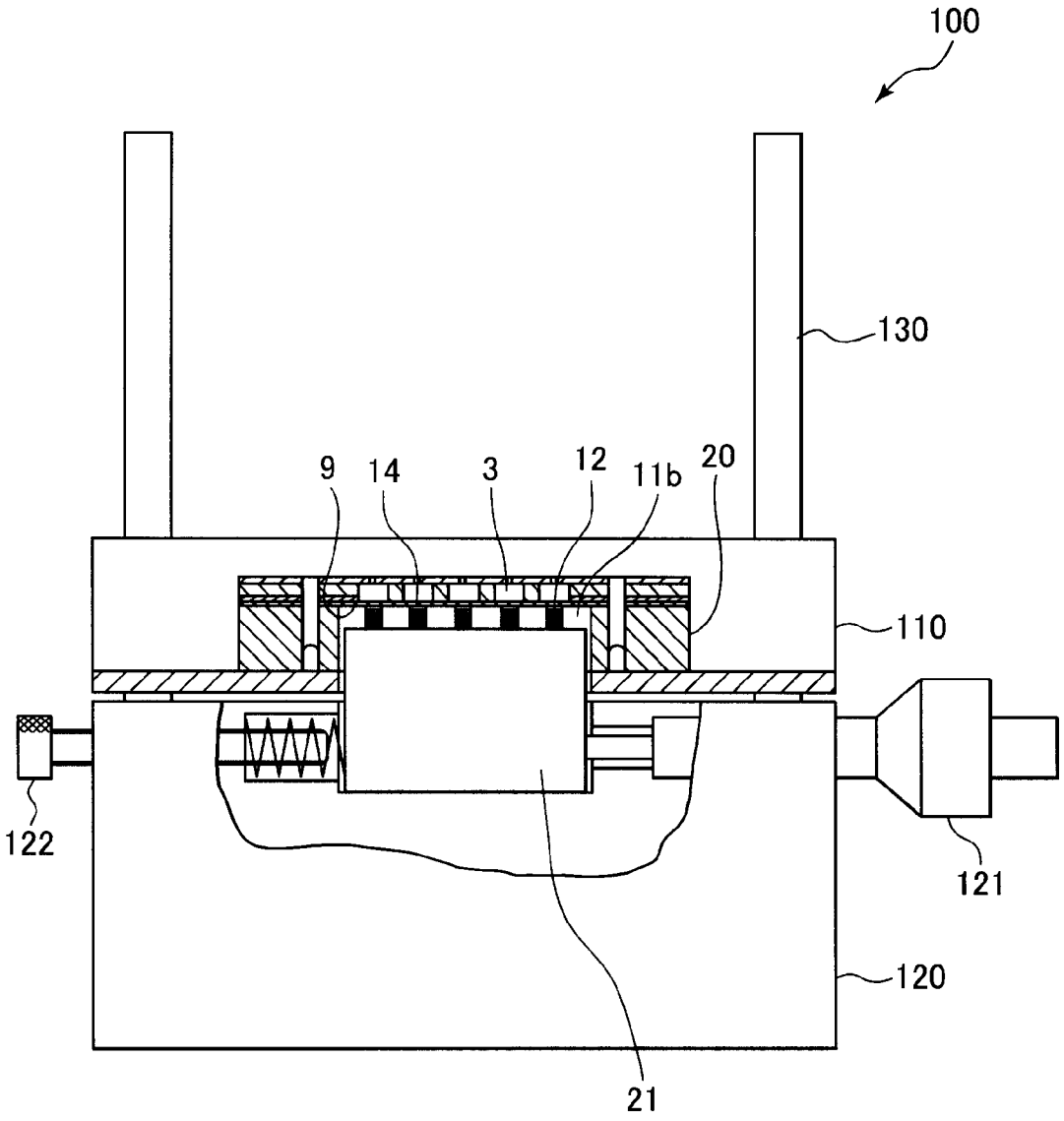
FIG. 11 is a frontal view in partial cross section showing the front end set and the piezoelectric element set being adhered together on the positioning jig.
Figure 12:
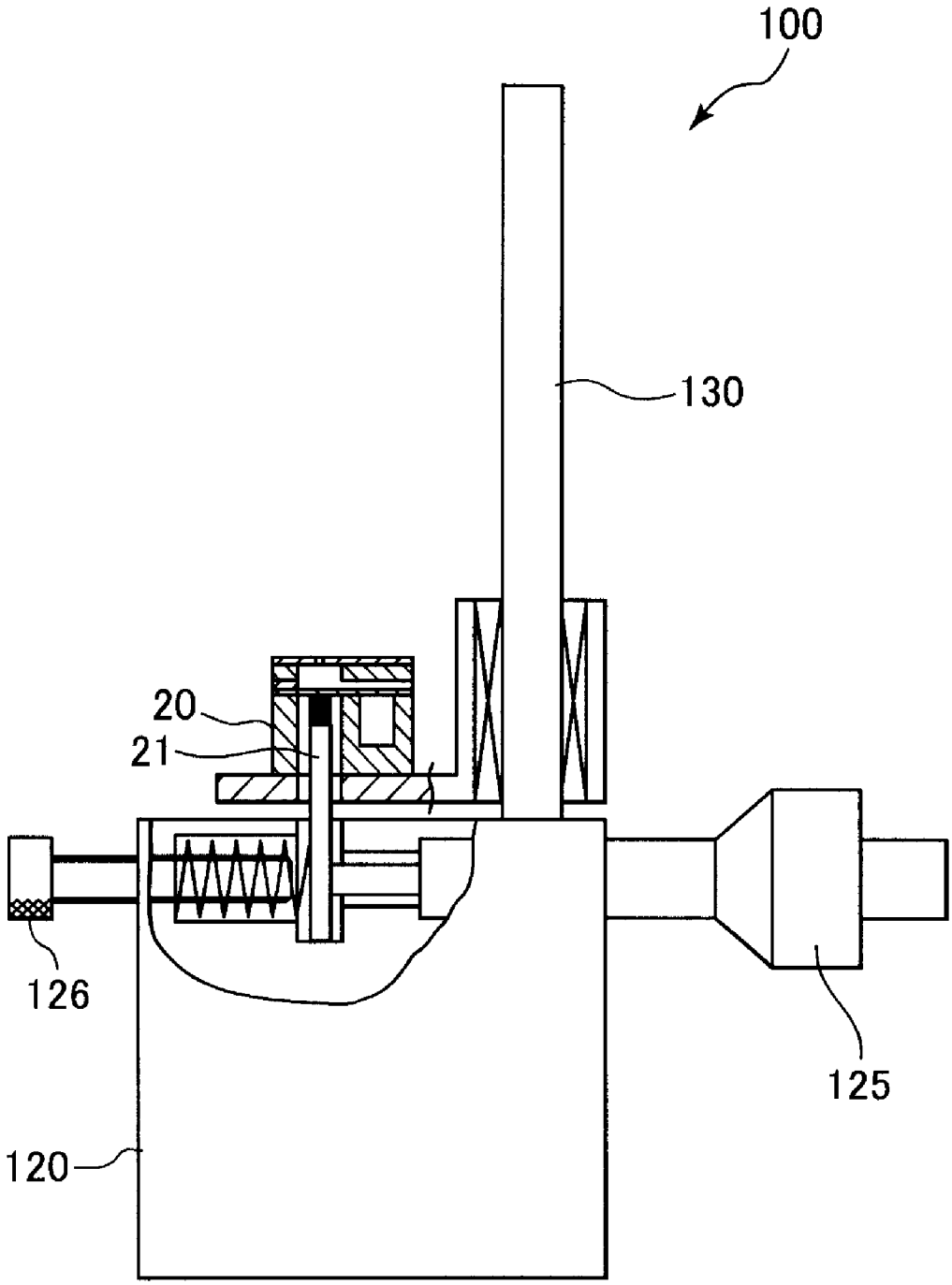
FIG. 12 is a right side view in partial cross section of the view of the FIG. 11.

Then, the front-end-set base 110 is moved downward toward the piezoelectric element-set base 120 using the positioning jig 100. At this time, the linear movement guide 130 maintains alignment between the front end set 20 and the piezoelectric element set 21. The front-end-set base 110 is moved downward until the piezoelectric element set 21 passes into the space 11*b* and, as shown in FIGS. 11 and 12, the diaphragm portion 7 and the piezoelectric elements 12 contact each other. As a result, the piezoelectric elements 12 of the piezoelectric element set 21 are adhered to the diaphragm portion 7 by the adhesive 14.

At this time, each piezoelectric element 12 will be positioned accurately in confrontation with a corresponding pressure chamber 3 because the piezoelectric element actuator 12 was positioned visually using the positioning plate 114 and because the positioning holes 115 and the dummy chambers 116 of the positioning plate 114 have the same positional relationship as the positioning holes 18 and the pressure chambers 3 of the front end set 20. The method of the present invention enables this accurate alignment without the need to provide a highly accurate positioning reference surface in the housing and without the need to manage the thickness of adhesive and the like in the manner of the conventional ink jet print head.

If the piezoelectric element 12 and the diaphragm portion 7 are shifted out of position, this can result in variations in how vibration is generated and in variations in the ink ejection characteristics of the various ink chambers. However, because the front end set 20 and the piezoelectric element set 21 are positioned using positioning jig 100 and adhered together with the gap 11*c* between the side walls 11*a* of the housing 11 and the fixing plate 13, the piezoelectric element 12 and the diaphragm portion 7 can be positioned accurately even if there is a certain amount of variation in machining precision of the components. Therefore, variation in ink ejection characteristics can be reduced.

Also, the front end set 20 and the housing 11 can be fixed together without the need to provide any further components. Because the number of required components is minimal, the ink jet head can be produced at low costs.

Further, because the housing 11 and piezoelectric element fixing plate 13 do not contact each other, no warping will occur from differences in expansion even if the housing 11 and the piezoelectric element fixing plate 13 are formed from different materials with different expansion coefficients. Therefore, the ink jet print head can be made inexpensively and with reduced variation in ink ejection properties.

Figure 13:
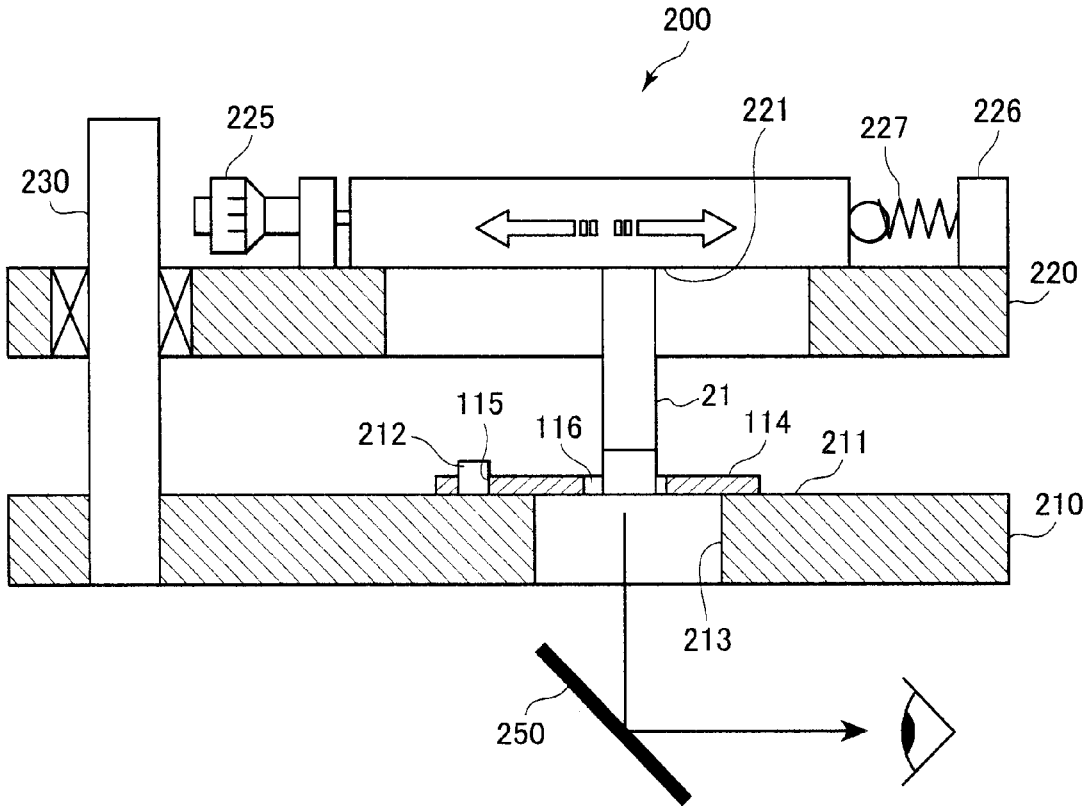
FIG. 13 is a frontal view in cross-section showing another example of a positioning jig.

FIG. 13 shows another positioning jig 200 for positioning the front end set 20 and the piezoelectric element set 21. The positioning jig 200 includes a front-end-set base 210, a piezoelectric element-set base 220, and a guiding jig having a linear movement guide 230. The linear movement guide 230 is fixed on the front-end-set base 210. The piezoelectric element-set base 220 is mounted on the linear movement guide 230 so as to be movable toward and away from the front-end-set base 210.

The front-end-set base 210 includes a support surface 211 formed with positioning pins 212 (only one shown in FIG. 13). The front-end-set base 210 is formed with an opening 213. An angled mirror 250 is provided below the opening 213 so that the operator can view through the opening 213 from below the opening 213. The piezoelectric element-set base 220 includes a support unit 221, a Y-direction micrometer head 225, an X-direction micrometer head (not shown) and fixing screws 226 (only one shown in FIG. 13) with springs 227 (only one shown in FIG. 13).

The piezoelectric element set 21 is mounted in the support unit 221. The positioning plate 114 is placed on the support surface 211 by fitting the positioning pins 212 into the positioning holes 115, 115. Then, the piezoelectric element-set base 220 is moved following the linear movement guide 230 downward toward the front-end-set base 210. While the piezoelectric element-set base 220 moves downward, the operator views the piezoelectric elements 12 from below through the dummy chambers 116 and the opening 213 using the mirror 250. While observing the piezoelectric elements 12, the operator uses the X-direction micrometer head and the Y-direction micrometer head 225 to move the piezoelectric element set 21 by minute distances in the X and Y directions until each piezoelectric element 12 is aligned with a corresponding dummy chamber 116. Then, the position of the piezoelectric element set 21 is fixed in place using the fixing screws 226.

Then, the piezoelectric element-set base 220 is raised upward and the positioning plate 114 is removed from the support surface 211. Next, the front end set 20 is placed on the support surface 211 by fitting the positioning pins 212 into the positioning holes 18, 18. Adhesive 14, while still uncured, is coated on either the diaphragm portion 7 or the piezoelectric elements 12.

Then, the piezoelectric element-set base 220 is moved downward toward the front-end-set base 210. At this time, the linear movement guide 230 maintains alignment between the front end set 20 and the piezoelectric element set 21. The piezoelectric element-set base 220 is moved downward until the piezoelectric element set 21 passes into the space 11*b* and the diaphragm portion 7 and the piezoelectric elements 12 contact each other. As a result, the piezoelectric elements 12 of the piezoelectric element set 21 are adhered to the diaphragm portion 7 by the adhesive 14.

Figure 15:
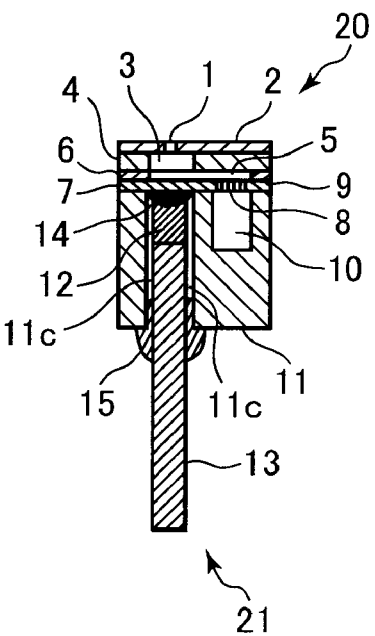
FIG. 15 is a right side cross-sectional view showing the ink jet print head of FIG. 14.
Figure 14:
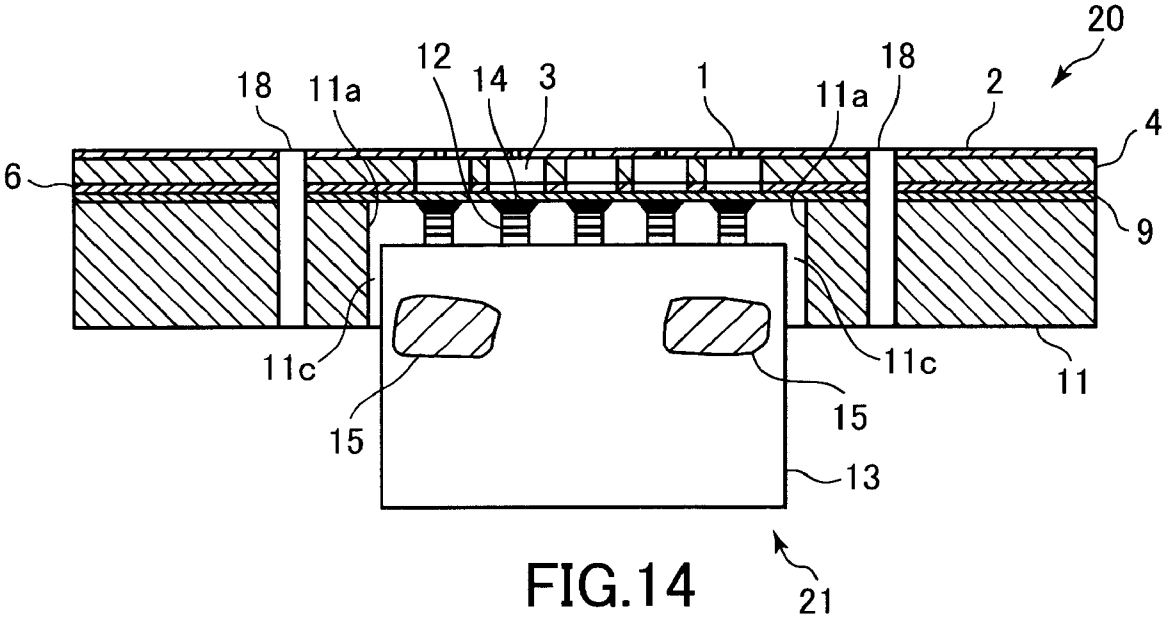
FIG. 14 is a frontal cross-sectional view showing the ink jet print head with sealing agent introduced at plural, separated positions of a gap between a housing and piezoelectric element fixing plate.
Figure 16:
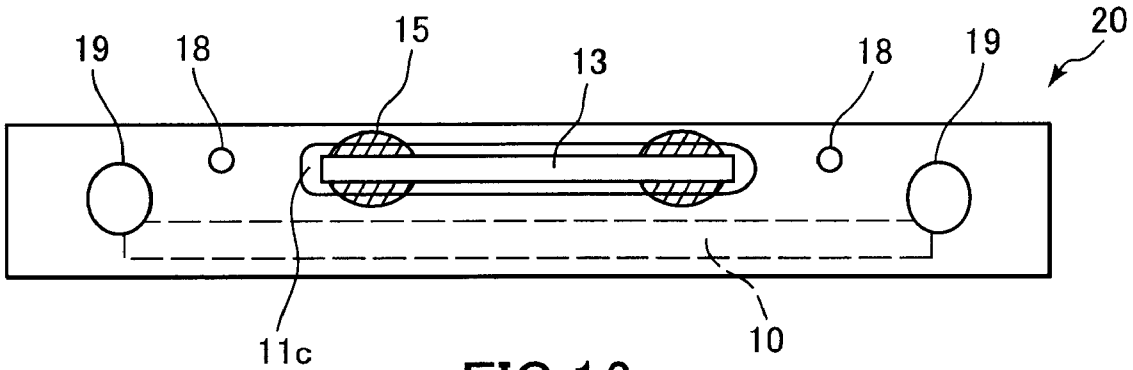
FIG. 16 is a lower view in partial cross-section showing the ink jet print head of FIG. 14.

As shown in FIGS. 14 to 16, sealing agent 15 or adhesive is introduced at a plurality of separated positions into the gap 11*c* between the side walls 11*a* of the housing 11 and the piezoelectric element fixing plate 13. The sealing agent 15 or adhesive serves as a resilient member that maintains the piezoelectric elements 12 in a predetermined positioning without completely fixing the piezoelectric element fixing plate 13 to the housing 11. The sealing agent 15 or adhesive has a Shore-A hardness of 90 degrees or less. Therefore, the sealing agent 15 or adhesive is soft and the housing 11 and the fixing plate 13 are not completely fixed in place. In this case, the same results can be achieved as if no sealing agent or adhesive, that is, a sealing agent or adhesive with Shore-A hardness of 0 degrees, were provided in the gap between the housing 11 and the fixing plate 13 as in the embodiment. Furthermore, the ink jet head can be better protected from external vibration and the like. With this configuration, the durability and reliability of the ink jet print head are enhanced.

Figure 18:
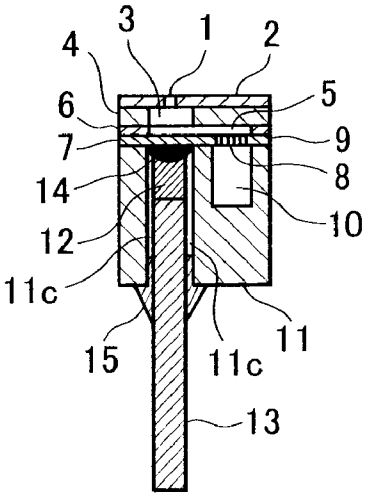
FIG. 18 is a right side cross-sectional view showing the ink jet print head of FIG. 17.
Figure 17:
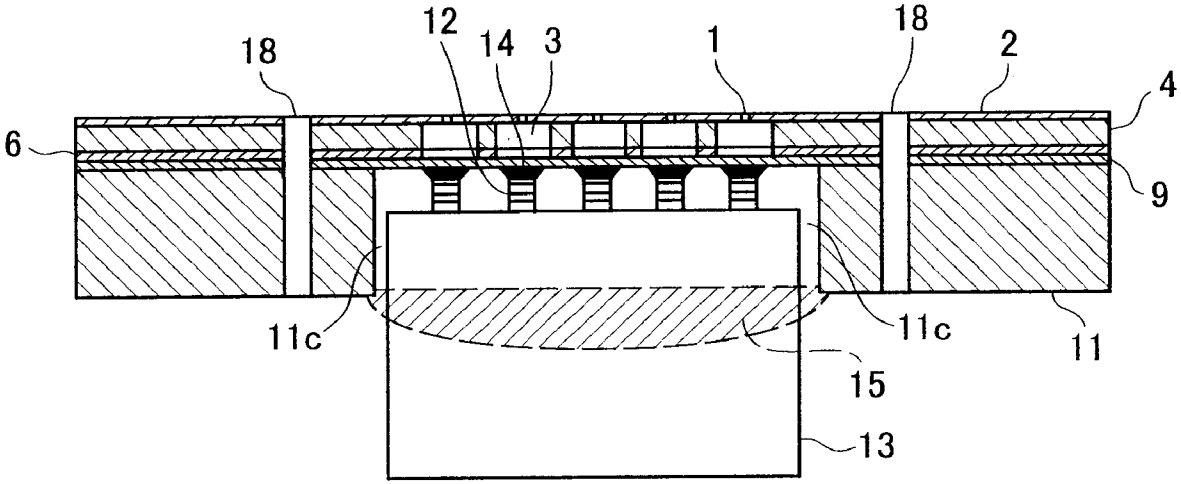
FIG. 17 is a frontal cross-sectional view showing the ink jet print head with sealing agent introduced completely around the piezoelectric element fixing plate in the gap between the housing and the piezoelectric element fixing plate.
Figure 19:
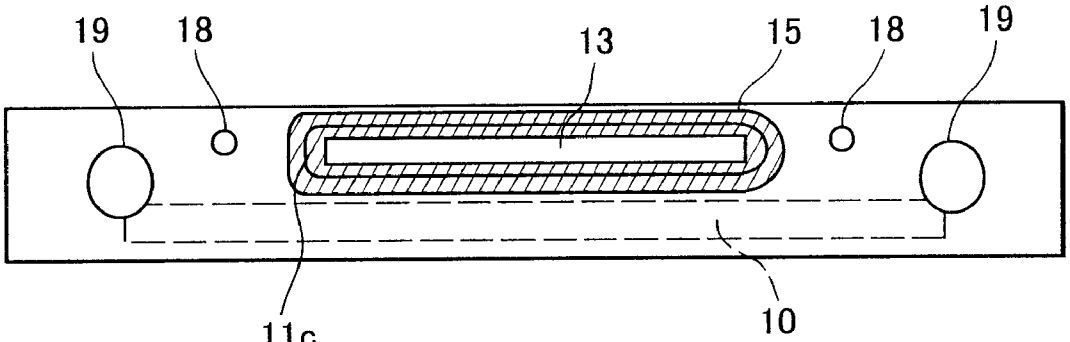
FIG. 19 is a lower view in partial cross-section showing the ink jet print head of FIG. 17.

Although the embodiment described applying the sealing agent 15 or adhesive at a plurality of separated positions between the piezoelectric element fixing plate 13 and the housing 11, as shown in FIGS. 17 to 19 the sealing agent 15 or adhesive can be applied to fill the entire external opening of the gap 11*c* in a continuous seal around the piezoelectric element fixing plate 13. With this configuration, the benefits of sporadically applying the sealing agent 15 as described in the embodiment are achieved, and the added benefit of preventing ink and the like from entering into the gap 11*c* is further achieved. If ink were to enter the gap 11*c*, then short circuits that adversely effect operations could occur. In this case, it is also desirable that the sealing agent 15 or adhesive have a Shore-A hardness of 90 degrees or less.

It is further desirable that in addition to the sealing agent 15 or adhesive having a Shore-A hardness of 90 degrees or less, the adhesive for attaching the piezoelectric elements 12 to the diaphragm portion 7 has a shore A hardness of 80 degrees or less. An adhesive with high hardness shrinks a great deal when hardening. When the adhesive for attaching the piezoelectric elements 12 to the diaphragm portion 7 has a shore A hardness of greater than 80 degrees, the reduction in volume during hardening excessively pulls on the piezoelectric element fixing plate 13 so that ink ejection properties of the corresponding pressure chamber can be affected. Variations in ink ejection properties can result. Also, an adhesive with a shore A hardness of greater than 80 degrees cannot effectively absorb differences in deformation amount caused by different coefficients of thermal expansion between the diaphragm/filter plate 109 and the piezoelectric element fixing plate 13 of the piezoelectric element set 21.

What is claimed is:

1. An ink jet print head comprising:

a pressure chamber portion with pressure chambers;

an orifice plate formed with orifices in a one-to-one correspondence with the pressure chambers, each orifice bringing a corresponding pressure chamber into fluid communication with atmosphere;

a restrictor plate formed with ink channels in fluid communication with the pressure chambers;

a diaphragm forming a side of the pressure chambers;

stacked piezoelectric elements each having a first end face and a second end face opposite from the first end face, the first end faces of the stacked piezoelectric elements being attached to the diaphragm in a one-to-one correspondence with the pressure chambers, each stacked piezoelectric element generating, through the diaphragm, a pressure fluctuation in a corresponding pressure chamber when applied with an electric signal;

a piezoelectric element fixing plate fixedly attached to the second end faces of the stacked piezoelectric elements and supporting the stacked piezoelectric elements; and a housing including:

a common ink channel portion formed with a common ink channel in fluid communication with the channels in the restrictor plate; and internal side walls that adjoin the diaphragm at one side to define a space that is open at an end opposite from the diaphragm, the piezoelectric element fixing plate and the stacked piezoelectric elements being disposed partially in the space with a gap existing between the piezoelectric element fixing plate and the internal side walls that define the space.

2. An ink jet print head as claimed in claim 1, further comprising at least one of sealing agent and adhesive with a Shore A hardness of 90 degrees or less disposed at a plurality of separated positions in the gap between the piezoelectric element fixing plate and the internal side walls of the space in the housing.

3. An ink jet print head as claimed in claim 2, further comprising an adhesive that attaches the piezoelectric elements to the diaphragm, the adhesive having a Shore A hardness of 80 degrees or less.

4. An ink jet print head as claimed in claim 1, further comprising at least one of sealing agent and adhesive disposed filling an entire external opening of the gap between the piezoelectric element fixing plate and the internal side walls of the space in the housing.

5. An ink jet print head as claimed in claim 4, wherein the at least one of sealing agent and adhesive has a Shore A hardness of 90 degrees or less.

6. An ink jet print head as claimed in claim 5, further comprising an adhesive that attaches the piezoelectric elements to the diaphragm, the adhesive having a Shore A hardness of 80 degrees or less.

7. An ink jet print head as claimed in claim 4, further comprising an adhesive that attaches the piezoelectric elements to the diaphragm, the adhesive having a Shore A hardness of 80 degrees or less.

8. An ink jet print head as claimed in claim 1, further comprising:

an adhesive that attaches the piezoelectric elements to the diaphragm, the adhesive having a Shore A hardness of 80 degrees or less; and at least one of sealing agent and adhesive with a Shore A hardness of 90 degrees or less disposed in the gap between the piezoelectric element fixing plate and the internal side walls of the space in the housing.

* * * * *